US007201681B2

(12) United States Patent
Solin

(10) Patent No.: US 7,201,681 B2
(45) Date of Patent: Apr. 10, 2007

(54) DEVICE FOR ALIGNING STRINGS OF A RACQUET

(76) Inventor: John R. Solin, 807 Schoenbeck Rd., Prospect Heights, IL (US) 60070

( * ) Notice: Subject to any disclaimer, the term of this patent is extended or adjusted under 35 U.S.C. 154(b) by 0 days.

(21) Appl. No.: 10/760,676

(22) Filed: Jan. 20, 2004

(65) Prior Publication Data

US 2005/0159254 A1 Jul. 21, 2005

(51) Int. Cl.
*A63B 49/00* (2006.01)

(52) U.S. Cl. ..... 473/553

(58) Field of Classification Search ..... 473/524, 473/553, 543; 81/2, 77, 484, 462, 177.6, 81/180.1, 491, 439, 440
See application file for complete search history.

(56) References Cited

U.S. PATENT DOCUMENTS

| | | | | |
|---|---|---|---|---|
| 1,572,542 | A | 2/1926 | Lawrence | |
| 4,089,523 | A * | 5/1978 | Newburger et al. | 473/553 |
| 4,489,942 | A | 12/1984 | Kent | |
| 4,662,632 | A | 5/1987 | Björhn | |
| 4,721,304 | A | 1/1988 | Zavilenski, Jr. | |
| 4,733,866 | A * | 3/1988 | Herbert | 473/553 |
| 4,752,071 | A | 6/1988 | Tabach | |
| 4,776,591 | A | 10/1988 | Ho | |
| 4,989,864 | A * | 2/1991 | Ubl | 473/553 |
| 5,035,429 | A | 7/1991 | Redrow | |
| 5,207,423 | A | 5/1993 | Short | |
| 5,222,998 | A | 6/1993 | Ferrari et al. | |
| 5,294,116 | A | 3/1994 | Ahrens | |
| 5,310,181 | A * | 5/1994 | Chan | 473/553 |
| 5,310,182 | A * | 5/1994 | Macknigg | 473/553 |
| 5,441,258 | A * | 8/1995 | Pagan | 473/553 |
| 5,653,441 | A | 8/1997 | Woltanski | |
| 5,823,900 | A * | 10/1998 | Harren et al. | 473/553 |
| 6,692,387 | B2 * | 2/2004 | Berens et al. | 473/553 |
| 2002/0193190 | A1 * | 12/2002 | Berens et al. | 473/524 |
| 2004/0048699 | A1 * | 3/2004 | Kim | 473/553 |

* cited by examiner

*Primary Examiner*—Raleigh W. Chiu
(74) *Attorney, Agent, or Firm*—Leydig, Voit & Mayer, Ltd.

(57) ABSTRACT

A handheld device for realigning the strings of a sports racquet, wherein the device is sized to fit into a clothing pocket of the user. The device comprises a body portion from which one or more alternately shaped protrusions extend. The protrusions generally include four-sided shapes that are sized and located along the body portion to be individually progressively received in the openings between the strings of the racquet, but not pass completely through the openings. Possible shapes include generally square, rectangular, trapezoidal, triangular, round, or oval shapes when viewed from the edge. The device is formed of a durable polymeric material that may readily be molded by conventional molding techniques.

27 Claims, 7 Drawing Sheets

24
34
44
54
20
II
II
34
24
44

III
III
36
54
46
56
22
28
IV
58
58
28
48
26
38

56
36
46
26
V
36
22
46
56
58
48
38
V
IV
48
38

FIG. 8
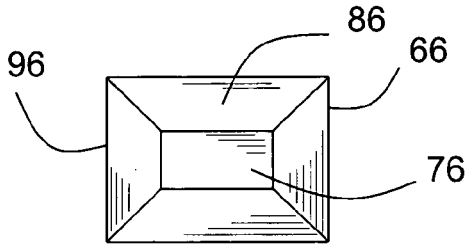
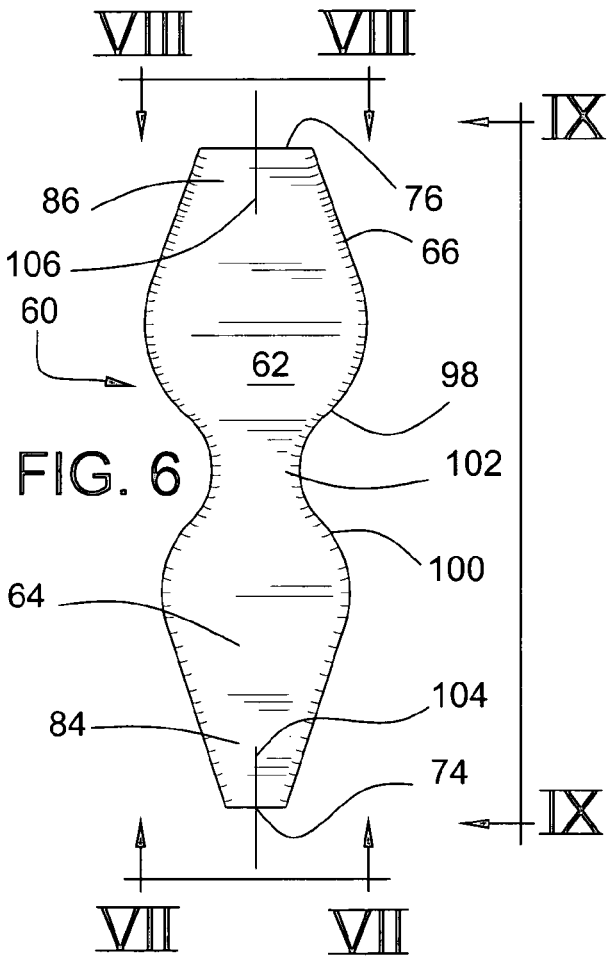
FIG. 6
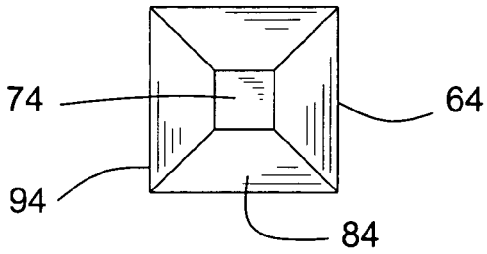
FIG. 7
FIG. 11
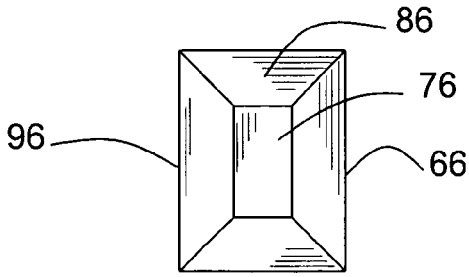
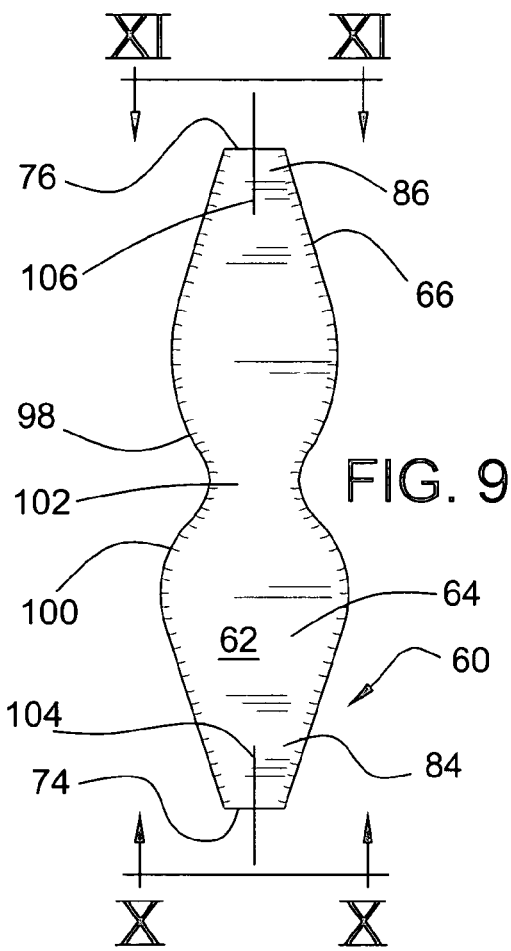
FIG. 9
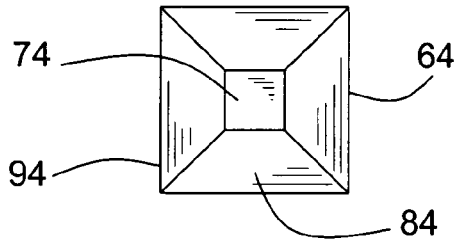
FIG. 10

FIG. 13
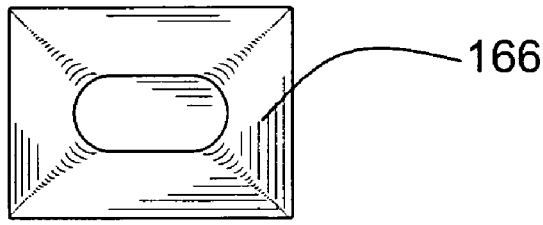
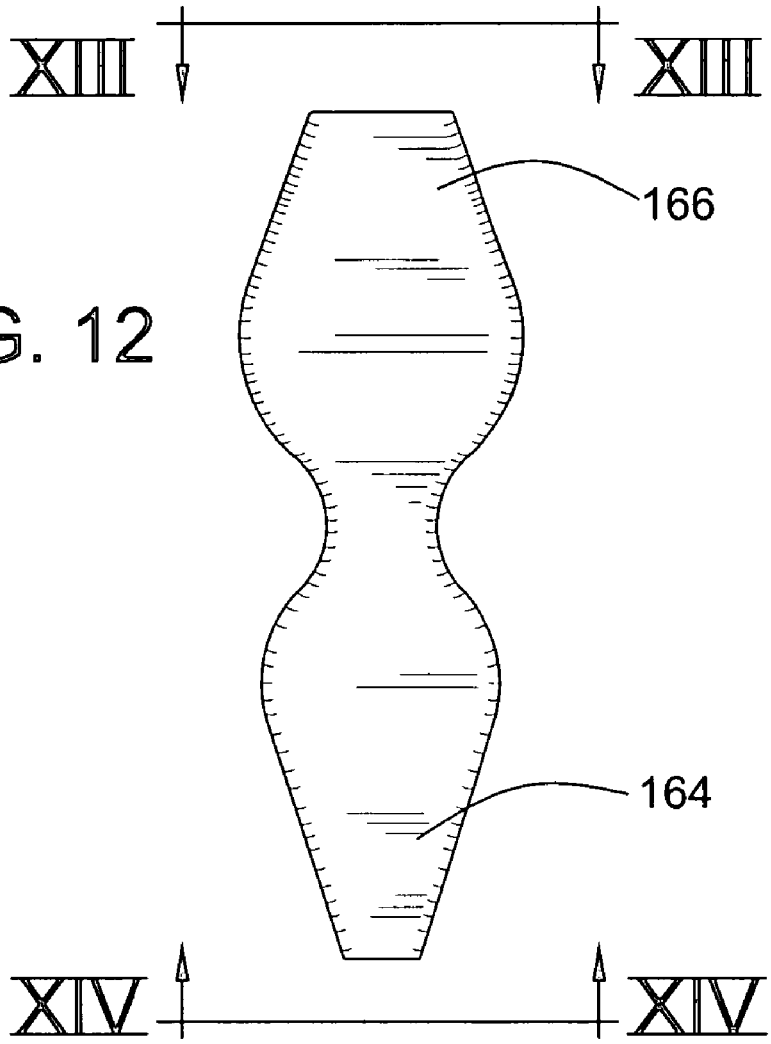
FIG. 12
FIG. 14
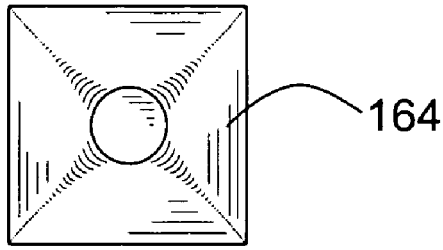

DEVICE FOR ALIGNING STRINGS OF A RACQUET

FIELD OF THE INVENTION

This invention generally relates to the stringed racquets, and, more particularly, to hand held devices used to realign or respace the vertical and horizontal positioning of the strings of such racquets that have moved during game use.

BACKGROUND OF THE INVENTION

Racquets having strings interwoven in a generally oval frame are used for sports such as tennis, racquetball, squash or badminton. Although strings are typically tightly interwoven, the strings undergo deforming forces that tend to force them from their desired orthogonal, grid-like relationships into misalignment. This misalignment affects the tension of the strings themselves, and alters the true hitting surface, which may result in an uneven or unpredictable force on the ball, and a miss-hit. As a result, it is not uncommon to see players realigning the strings with his/her fingers during a match.

While devices exist for realigning racquet strings, most are cumbersome to use or bulky arrangements that cannot typically be carried with the player on the court. Consequently, the player must frequently retreat to the sidelines to realign racquet strings. For example, devices such as those disclosed in U.S. Pat. Nos. 4,489,942, 4,989,864, and 5,441,258 include large grid-like patterns of protrusions that are designed to engage the openings between the strings of the racquet substantially simultaneously. The protrusions are narrower at the tip than at their base such that as they are forced into the openings between the strings, the strings move from the tip outward along the slanted or rounded surfaces of the protrusion to the enlarged base, the strings are forced back into their proper alignment. These arrangements, however, typically require the racquet to be placed on a flat surface or otherwise supported in order to facilitate application of an appropriate straightening force to the strings. Although the arrangements disclosed in U.S. Pat. Nos. 4,489,942 and 5,441,258 attempt to minimize or eliminate the need for such external support by providing a cover hinged to the aligning base or a bracket for pivoting the base to the racquet, respectively, the arrangements are cumbersome, and a consistent straightening force is most readily applied by supporting the racquet on another surface. Moreover, these devices are necessarily limited to a particular string arrangement. They are also relatively large and clearly could not be carried in the player's pocket or utilized on the court.

While U.S. Pat. Nos. 4,089,523, 4,733,866, 5,207,423, 5,310,181 and 5,310,182 attempt to overcome the difficulties with the sheer size of the above devices by providing rotating presentations of such grids, smaller versions of such grids, or single rows of such grids, such devices still present numerous drawbacks. As an initial matter, the devices are still relatively large and not readily carried by the player in a pocket for use on the court. Further, it is difficult to apply a consistent straightening force to the device without supporting the racquet on another surface. They are also not particularly useful with irregular stringing arrangements that differ from the traditional horizontal and vertical pattern. Finally, these smaller devices, as well as their larger counterparts, do not provide any mechanism for effectively straightening the strings surrounding the more elongate openings at the edges of the racquet.

Another common type of aligner utilizes a plurality of small combs to pull or push the strings into alignment. Such devices are disclosed, for example, in U.S. Pat. Nos. 4,776,591, 5,035,429, and 5,653,441. These devices are awkward to use, however, and may produce inconsistent results. As a result, as with most other devices, the racquet is often set down in order to effectively utilize these types of devices. As with the grid type arrangements, these devices may not be useful with irregularly strung racquets. Moreover, even if such devices are made small enough to fit into the player's pocket, the plurality of protruding teeth on the device present sharp edges that may snag in the player's pocket, making use of the device on the court between play impractical. Such snagging is likewise exhibited with the multi-angle bent wire of U.S. Pat. No. 4,752,071.

BRIEF SUMMARY OF THE INVENTION

The invention provides a handheld device for realigning the strings of a racquet, such as a tennis, racquetball, squash, or badminton racquet. The device comprises a body portion from which one or more alternately shaped protrusions extend. The protrusions generally include four-sided shapes that are sized to be progressively received in the openings between the strings of the racquet, but not pass completely through the openings. Preferably, at least one of the protrusions has a generally square shape when viewed from the edge, and another generally rectangular, such that the square shape may be received between the preferably square openings of the strings and the rectangular shape may be received in the spaces between the strings disposed adjacent the frame of the racquet. Protrusions of alternate shapes may be provided that reflect the shape of the preferable opening between the racquet strings. For example, a protrusion may have a generally trapezoidal shape when viewed from the edge such that the protrusion would be particularly useful in realigning the strings of a racquet wherein a portion of the string pattern fans out from a location along the frame.

The device preferably includes two or three such protrusions, although it may include a single such protrusion or more than three protrusions. In an embodiment wherein the device includes two such protrusions, the body portion may be elongated and include a generally centrally located necked-in portion to facilitate handling of the device during use and application of the straightening force. Alternately, if the device includes three such protrusions, the body preferably has a generally triangular disk-like shape, the variously sized protrusions extending outward at the comers of the triangular disk.

The device is preferably formed of a durable polymeric material and is sized to easily fit into the pocket of the player. Further, the device is shaped such that it will not readily become snagged in the pocket between uses. Thus, between plays, the user may easily remove the device from his/her pocket, insert the appropriate protrusion into the opening between the strings and twist or rock the device or perform a combination of these actions to pry and straighten the few strings that may have become distorted, then return the device to his/her pocket and continue play. Typically, the user will not need to insert the device into each and every opening. Rather the user may skip an opening or so inasmuch as straightening essentially all the strings may be accomplished by straightening the strings surrounding only a portion of the openings.

The device may also readily be utilized for advertising purposes. It presents various surfaces upon which a promoter could present identifying information, such as company name, address, phone number, website, or event information or the like.

These and other advantages of the present invention, as well as additional inventive features, will be apparent from the description of the invention provided herein. Further features and advantages of the present invention, as well as the structure and operation of various embodiments of the present invention, are described in detail below with respect to the accompanying drawings. In the drawings, like reference numerals indicate identical or similar elements.

BRIEF DESCRIPTION OF THE DRAWINGS

FIG. 6 is a plan view of another embodiment of a device for aligning stings on racquets constructed in accordance with teachings of the invention.

FIG. 7 is an end view of the device of FIG. 6 taken along line VII—VII in FIG. 6.

FIG. 8 is an end view of the device of FIG. 6 taken along line VIII—VIII in FIG. 6.

FIG. 9 is a side view of the device of FIG. 6 taken along line IX—IX in FIG. 6.

FIG. 10 is an end view of the device of FIG. 6 taken along line X—X in FIG. 9.

FIG. 11 is an end view of the device of FIG. 6 taken along line XI—XI in FIG. 9.

FIG. 12 is plan view of another embodiment of a device for aligning stings on racquets constructed in accordance with teachings of the invention.

FIG. 13 is an end view of the device of FIG. 12 taken along line XIII—XIII in FIG. 12.

FIG. 14 is an end view of the device of FIG. 12 taken along line XIV—XIV in FIG. 12.

DETAILED DESCRIPTION OF THE DRAWINGS

Figures 1, 2, 3, 4, 5:
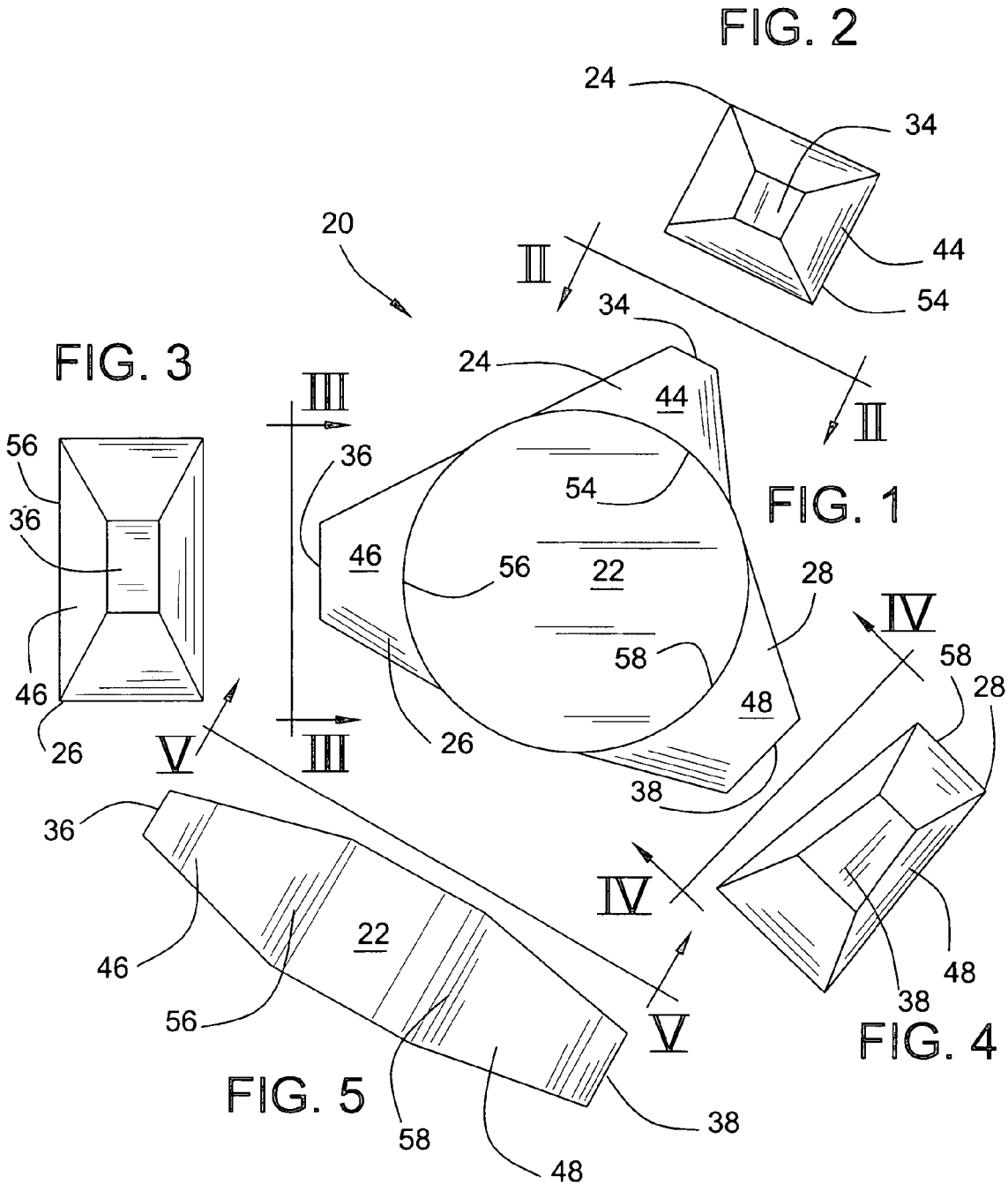
FIG. 1 is a plan view of a device for aligning stings on racquets constructed in accordance with teachings of the invention.
FIG. 2 is side elevational view of the device of FIG. 1 taken along line II—II in FIG. 1.
FIG. 3 is side elevational view of the device of FIG. 1 taken along line III—III in FIG. 1.
FIG. 4 is a side elevational view of the device of FIG. 1 taken along line IV—IV in FIG. 1.
FIG. 5 is a side elevational view of the device of FIG. 1 taken along line V—V in FIG. 1.
Figure 15:
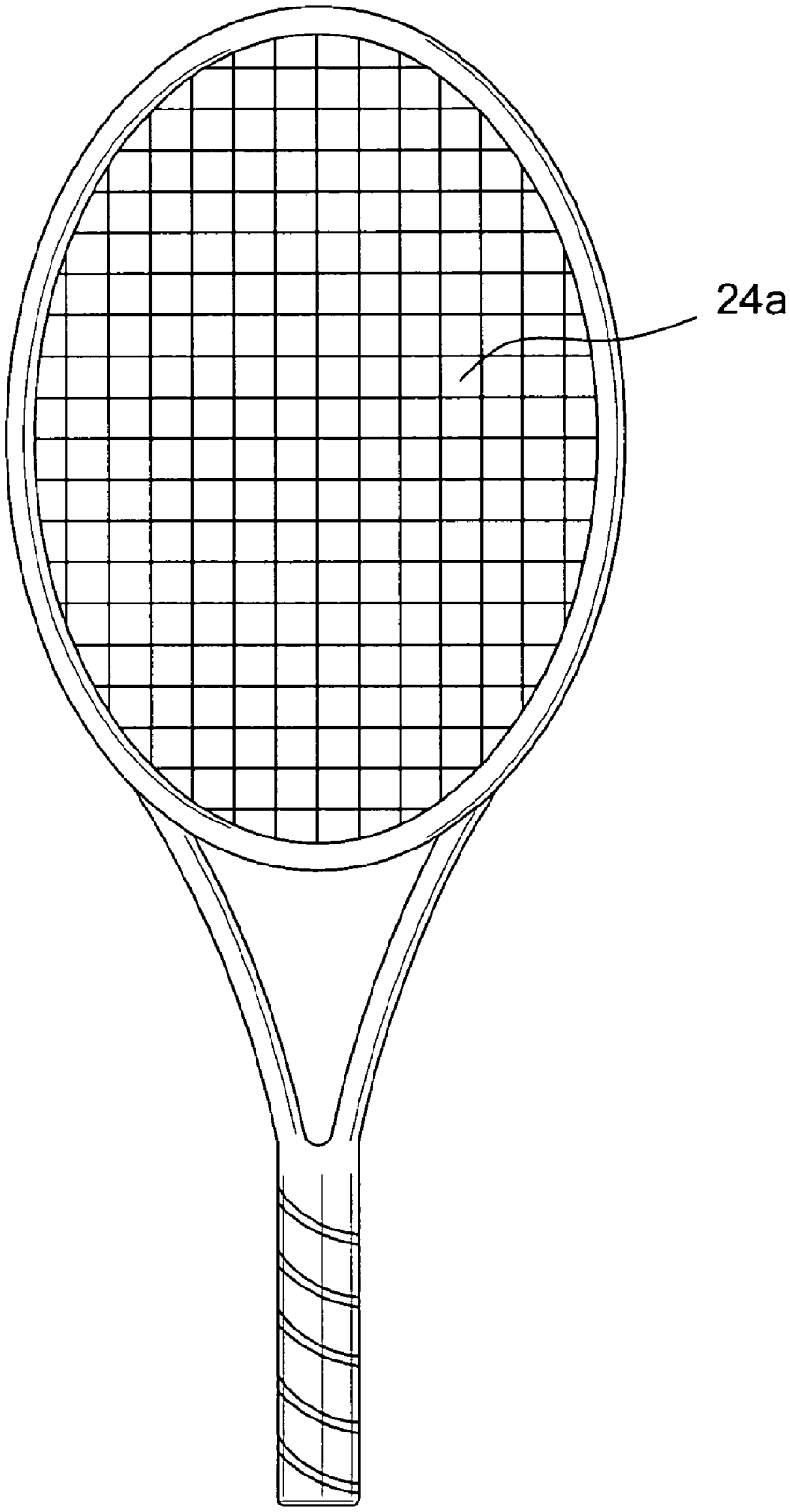
FIG. 15 is a plan view of a racquet having a conventional parallel string arrangement.
Figure 16:
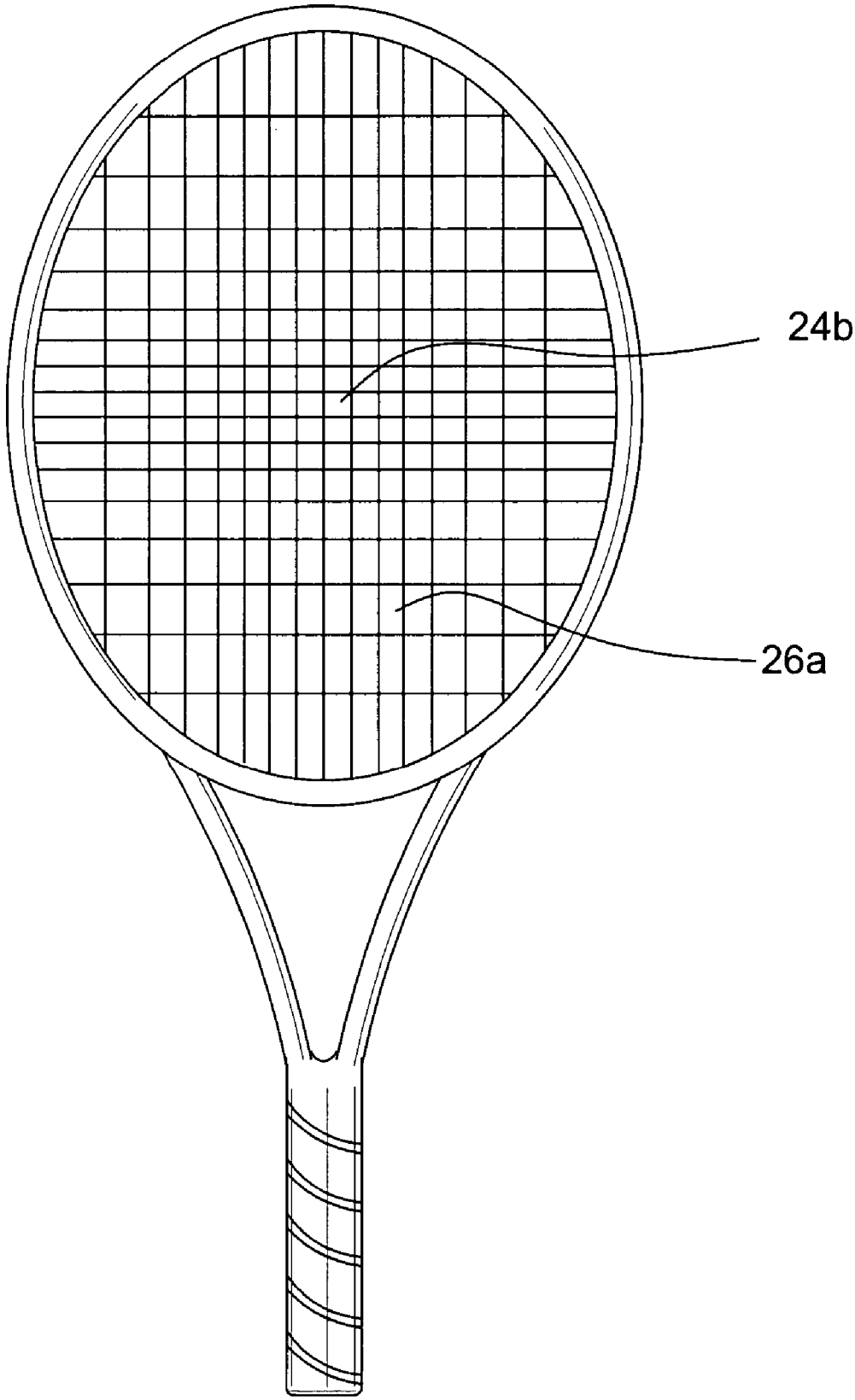
FIG. 16 is a plan view of a racquet having a configuration wherein the strings are closer together near the center of the racquet.

Turning now to the drawings, there is shown in FIG. 1 a device 20 for realigning or straightening the strings of a racquet. For the purposes of this disclosure, the terms "realigning" and "straightening" are intended to be interchangeable and denote the same action. In accordance with the invention, the device 20 includes a body portion 22 from which a plurality of singular protrusions 24, 26, 28 extend. While the illustrated embodiment comprises three such protrusions, it will be appreciated that the device may include a single protrusion, two protrusions, or four or more protrusions, each preferably designed to realign the strings of a particular stringing arrangement. In order to facilitate straightening of the racquet strings, the protrusions 24, 26, 28 each have a shape that generally reflects the optimal shapes of the spaces between the strings of different types of racquets. For example, the protrusion 24 as shown in FIG. 2 includes a generally square shape, while the protrusion 26 as shown in FIG. 3 includes a generally rectangular shape. The openings between the horizontal and vertical strings of racquets, such as the racquet shown in FIG. 15, have the strings disposed in a parallel arrangement that present such square shapes 24*a*. The openings between the horizontal and vertical strings of racquets, such as the racquet shown in FIG. 16, have the strings disposed in parallel arrangement that present such square shapes 24*b* in the central portion of the racquet, and rectangular openings 26*a* at the positions near where the strings attach to the frame of the racquet.

Figure 17:
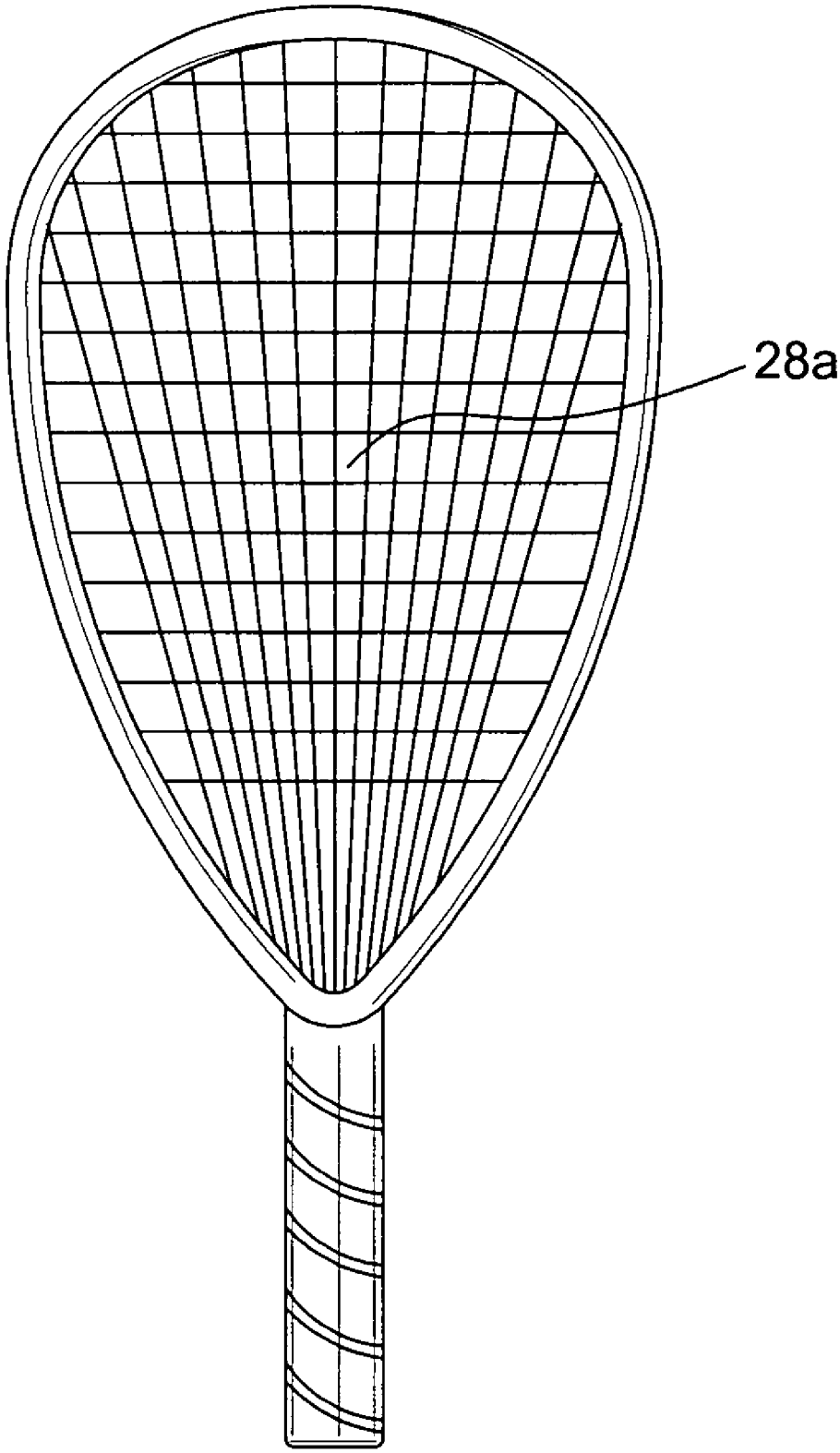
FIG. 17 is a plan view of a racquet having a configuration wherein the strings fan out from a location along the frame.

In order to likewise allow the device 20 to be utilized with racquets that include a stringing arrangement that has other than parallel strings, such as an arrangement where the strings fan out from one edge of the racquet frame, such as the racquet shown in FIG. 17, the third protrusion 28 preferably has a trapezoidal shape when viewed from the edge, as shown in FIG. 4, which correspond to trapezoidal openings 28*a* as shown in FIG. 17. In this way, this single device may be utilized to realign the strings not only of a traditional rectangular stringing arrangement, but also of a fan type of stringing arrangement wherein the strings extending generally in one direction appear to fan out from a single edge of the racquet.

Each of the protrusions 24, 26, 28 preferably has a frustum shape that includes a relatively small, distal end 34, 36, 38, from which the walls 44, 46, 48 of the protrusion 24, 26, 28 slope downward and outward to a larger base 54, 56, 58 adjacent the body portion 22. It will be appreciated, however, that the protrusions may have a pyramidal shape or a more rounded shape with the walls extending downward and outward to a larger base at the body portion.

Another embodiment of the invention is shown in FIGS. 6–11. In this embodiment, the device 60 includes a body portion 62 from which two such frustum-shaped protrusions 64, 66 extend. The first of the protrusions 64 has a generally square shape, while the second of the protrusions 66 includes a generally rectangular shape, as with protrusions 24 and 26 above, respectively. Thus, this embodiment of the invention is particularly useful in realigning the strings of a racquet wherein the strings are strung in conventional right angle arrangement. As with the first embodiment of the invention, the protrusions 64, 66 each include a relatively small, distal end 74, 76 from which walls 84, 86 extend outward and downward to a relatively larger base 94, 96.

As with the embodiments of FIGS. 1–11, the protrusions of the device may be provided with an alternate structure. For example, as shown in the embodiment in FIGS. 12–14, the protrusions may have a relatively rounded profile, such as protrusions 164, 166.

The devices 20, 60 are utilized in essentially the same manner. In order to facilitate the application of a force to realign the strings, the device 60 is provided with one or more surfaces 98, 100 against which the user may readily exert a force to accomplish the necessary prying, rotating, rocking or straightening motion. In this way, the device 60 includes one or more areas 98, 100 that are at an angle to the axes 104, 106 that would run through the center of the protrusions 64, 66. In the illustrated embodiment, the surfaces 98, 100 are formed by a necked-in area 102 that is generally centrally located along the length of the device 60.

In this way, as the user utilizes the square protrusion 64, for example, the user's fingers may exert the necessary force against the surface 100. Conversely, the user may exert a force against surface 98 when utilizing the rectangular protrusion 66. It will further be appreciated by those of skill in the art that the necked-in area 100 provides a better, more comfortable grip on the device 60 during use.

Figure 18:
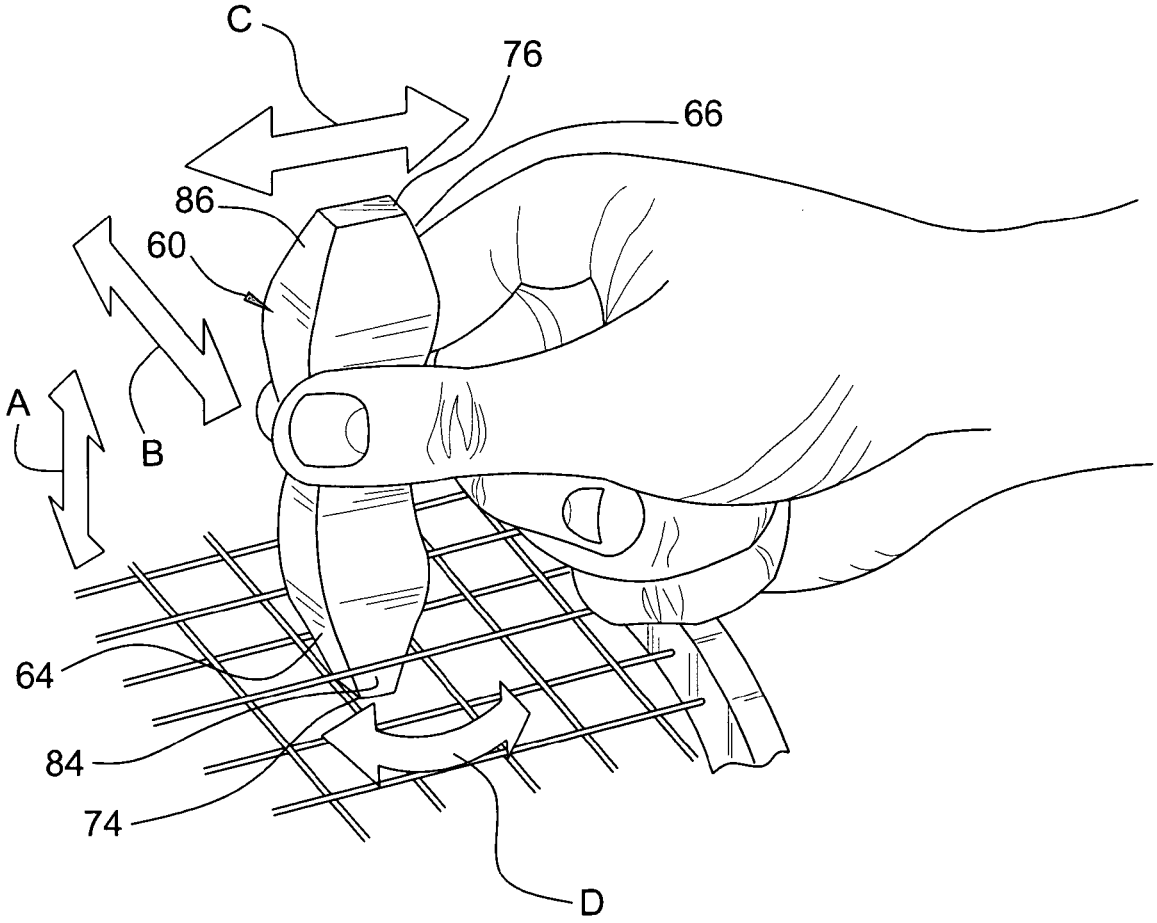
FIG. 18 is a perspective view of the embodiment of the device illustrated in FIGS. 6–11 during use.

Thus, in use, the player may insert the smaller, distal end 34, 36, 38, 74, 76 of the protrusion 24, 26, 28, 64, 66 into a relatively small distorted opening between misaligned strings. (A. graphic representation of the use of the device 60 is illustrated in FIG. 18.) The user inserts the device 20, 60 into an opening between the strings, applying a linear force normal to the plane of the string arrangement (see arrow A in FIG. 18), and then preferably either a rocking (see arrows B and C in FIG. 18) or reciprocating limited rotational movement (see arrow D in FIG. 18) to the device 20, 60, with or without a linear-force relative the strings (A). As this "prying" force is applied, the strings slide downward and outward along the walls 44, 46, 48, 84, 86 of the protrusions 24, 26, 28, 64, 66 to realign the strings to their optimal position. Inasmuch as the relatively few strings are typically displaced in a given play, the device 20, 60 may be quickly utilized to realign the strings between plays without interrupting the flow of the game.

In summary, the device provides a compact, easy to use string-realignment tool that may be kept in the pocket of the player and quickly utilized between plays to realign distorted strings. It may include variously shaped protrusions for realigning the strings in numerous string patterns. The device is lightweight, and may be economically fabricated from conventional molding techniques using any appropriate material, such as, for example, polyethylene or polypropylene. The device presents no sharp edges that would snag in the player's pocket and inhibit ready access to the device. The device has a shape that is easily held and easily manipulated and utilized by the player. The device may be utilized with various string patterns for respacing the racquet strings of sport racquets such as tennis, racquetball, squash and badminton racquets. The device is utilized with prying leverage rather than linear force. The device does not require the user to support the racquet on a separate surface in order to effectively straighten and realign the strings. The device is durable.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A handheld device for utilization by user in straightening the strings of a sports racquet having a grid of such strings that form a plurality of openings therebetween, the device comprising a body portion, at least two protrusions extending from said body portion, said protrusions having a relatively small distal end from which walls extend downward and outward to a relatively larger base adjacent the body portion, the at least two protrusions each having a central axis, said central axes of the protrusions being disposed at an angle to one another such that only one said protrusion may be utilized at any given time to enter said opening in said racquet to straighten the adjacent strings, the body portion comprises a force-receiving surface disposed at an angle to at least one of said axes, the body portion comprises a necked-in portion, said necked-in portion forming the force-receiving surface.

2. The handheld device of claim 1 wherein the protrusions comprise a generally polygonal frustum shape.

3. The handheld device of claim 2 wherein one of the distal ends comprises a generally square shape.

4. The handheld device of claim 3 wherein one of the distal ends comprises a generally rectangular shape.

5. The handheld device of claim 1 wherein one of the distal ends comprises a general trapezoidal shape.

6. The handheld device of claim 1 wherein one of the distal ends comprises a generally round shape.

7. The handheld device of claim 1 wherein one of the distal ends comprises a generally oval shape.

8. The handheld device of claim 1 wherein the body portion is elongated.

9. The handheld device of claim 1 wherein the device is formed of a polymeric substance.

10. The handheld device of claim 1 wherein the at least two protrusions are of at least one of a different size or a different shape.

11. The handheld device of claim 1 wherein the device is small enough to fit into a clothing pocket of the user.

12. The handheld device of claim 1 wherein the axes are disposed at 180° to one another.

13. A handheld device for utilization by user in straightening the strings of a sports racquet having a grid of such strings that form a plurality of openings therebetween, the device comprising a body portion, at least three protrusions extending from said body portion, said protrusions having a relatively small distal end from which walls extend downward and outward to a relatively larger base adjacent the body portion, said protrusions being adapted to enter said opening in said racquet to straighten the adjacent strings;

wherein a first protrusion comprises a generally rectangular shape, a second protrusion comprises a generally square shape, and a third protrusion comprises a generally trapezoidal shape.

14. The handheld device of claim 13 wherein each of the at least three protrusions comprises a generally polygonal frustum shape.

15. The handheld device of claim 13 wherein the body portion has a generally disk-like shape.

16. The handheld device of claim 13 wherein the device is formed of a polymeric substance.

17. The handheld device of claim 13 wherein the device is small enough to fit into a clothing pocket of the user.

18. A handheld device for utilization by user in straightening the strings of a sports racquet having a grid of such strings that form a plurality of openings therebetween, the device comprising a body portion, at least two protrusions extending from said body portion, said protrusions having a relatively small distal end from which walls extend downward and outward to a relatively larger base adjacent the body portion, the at least two protrusions each having a central axis, said central axes of the protrusions being disposed at an angle to one another such that only one said protrusion may be utilized at any given time to enter said opening in said racquet to straighten the adjacent strings, the body portion has a generally disk-like shape.

19. The handheld device of claim 18 wherein the protrusions comprise a generally polygonal frustum shape.

20. The handheld device of claim 19 wherein one of the distal ends comprises a generally square shape.

21. The handheld device of claim 20 wherein one of the distal ends comprises a generally rectangular shape.

22. The handheld device of claim 18 wherein one of the distal ends comprises a general trapezoidal shape.

23. The handheld device of claim 18 wherein one of the distal ends comprises a generally round shape.

24. The handheld device of claim 18 wherein one of the distal ends comprises a generally oval shape.

25. The handheld device of claim 18 wherein the device is formed of a polymeric substance.

26. The handheld device of claim 18 wherein the at least two protrusions are of at least one of a different size or a different shape.

27. The handheld device of claim 18 wherein the device is small enough to fit into a clothing pocket of the user.

* * * * *

UNITED STATES PATENT AND TRADEMARK OFFICE

CERTIFICATE OF CORRECTION

PATENT NO. : 7,201,681 B2
APPLICATION NO. : 10/760676
DATED : April 10, 2007
INVENTOR(S) : John R. Solin It is certified that error appears in the above-identified patent and that said Letters Patent is hereby corrected as shown below:

Column 3, Line 15: "stings" should read --strings--.

Column 3, Line 27: "stings" should read --strings--.

Column 3, Line 40: "stings" should read --strings--.

Column 5, Line 11: "(A. graphic" should read --(A graphic--.

Signed and Sealed this

Twenty-fifth Day of November, 2008

JON W. DUDAS
*Director of the United States Patent and Trademark Office*